United States Patent [19]

Busse et al.

[11] 4,238,945

[45] Dec. 16, 1980

[54] APPARATUS FOR BENDING A JACKETED TUBE

[75] Inventors: Fritz Busse, Hilden; Hans-Walter Busch; Peter Michelatsch, both of Solingen, all of Fed. Rep. of Germany

[73] Assignee: Rigobert Schwarze, Cologne, Fed. Rep. of Germany

[21] Appl. No.: 973,073

[22] Filed: Dec. 22, 1978

[51] Int. Cl.[3] ..... B21D 9/05

[52] U.S. Cl. ..... 72/150; 72/369

[58] Field of Search ..... 72/150, 149, 154, 155, 72/156, 159, 369, 370, 217; 29/455 R, 445, 157 R, 234

[56] References Cited

U.S. PATENT DOCUMENTS

| | | | |
|---|---|---|---|
| 2,962,077 | 11/1960 | Condiff | 72/150 |
| 3,546,917 | 12/1970 | Paine | 29/423 |
| 4,009,601 | 3/1977 | Shimizu | 72/150 |
| 4,137,743 | 2/1979 | Schwarze | 72/150 |

*Primary Examiner*—Daniel C. Crane

*Attorney, Agent, or Firm*—Michael J. Striker

[57] ABSTRACT

An elongated bending core is inserted coaxially in an elongated outer tube. The core has at least one recess which extends along the elongation of the core. An elongated inner tube is inserted into the recess so that the inner and outer tubes together constitute a jacketed tube. The jacketed tube is bent about an axis which is normal to the longitudinal axis thereof to thereby bend the inner and outer tubes simultaneously.

6 Claims, 6 Drawing Figures

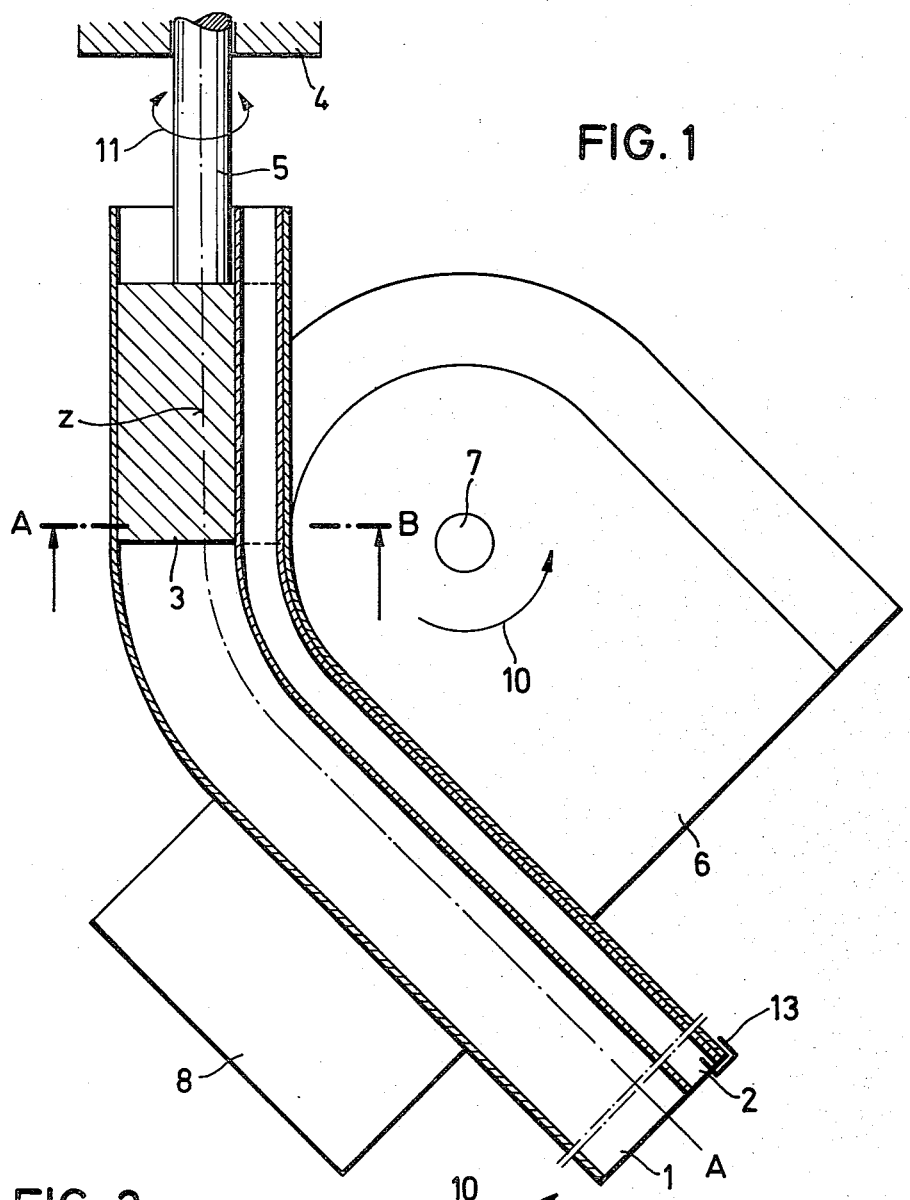
FIG. 1
FIG. 2
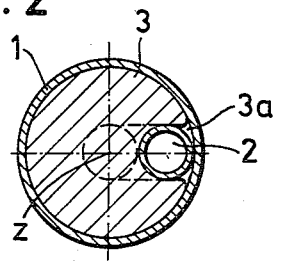
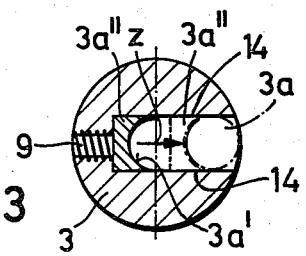
FIG. 3

APPARATUS FOR BENDING A JACKETED TUBE

BACKGROUND OF THE INVENTION

The present invention relates to arrangements for bending tubes.

More particularly, the present invention concerns arrangements for cold bending jacketed tubes.

A jacketed tube includes an outer tube and at least one inner tube which extends inside the outer tube either coaxially or eccentrically relative thereto.

The prior art teaches arrangements for cold bending a jacketed tube in one step, if the jacketed tube includes the coaxial inner and outer tubes. The arrangement for this purpose includes at least one circular bending core and at least one mandrel. The circular core is inserted between the outer and inner tubes and it takes care of centering the outer and inner tubes relative to each other. The mandrel is inserted into the inner tube in the area of the circular core, and it is operative to provide an elongated smooth bending support inside the jacketed tube. In order to insure an axial alignment of the inner and outer tubes, the same are connected to each other at the respective end portions thereof before the bending process starts.

This method of cold bending of the jacketed tube by means of the circular core and the mandrel proved to be very efficient when the inner tube extends coaxially in the outer tube. However, this method and this arrangement as well, cannot be used when it comes to the inner tube which extends eccentrically inside the outer tube.

A method has been suggested of manufacturing a fuel filter neck which includes a jacketed tube comprising an inner tube which extends eccentrically inside an outer tube. In accordance with this method the jacketed tube is manufactured in many relatively complicated steps. Thus, at least the outer tube is bent separately and separate paths of the inner tube of flexible synthetic plastic material are consecutively introduced in the bent outer tube. Thereafter, these separate parts are arrested inside the outer tube. Thus, such a jacketed tube with the inner tube extending eccentrically inside the outer tube is stipulated by the different parts of the inner tube, by the complicated connection of these parts in the outer tube, and by separate installation of these separate parts inside the bent outer tube.

SUMMARY OF THE INVENTION

It is a general object of the present invention to avoid the disadvantages of the prior art arrangements for and methods of cold bending jacketed tubes.

More particularly, it is an object of the present invention to provide an arrangement for and a method of cold bending a jacketed tube, which has an inner tube extending eccentrically inside an outer tube, in one bending step.

Another object of the present invention is to provide an arrangement for cold bending the jacketed tubes, which includes only one relatively simple element and therefore can be used in a simple and reliable manner.

In pursuance of these objects and others which will become apparent hereafter, one feature of the present invention resides in providing a method of bending a jacketed tube, which method comprises the steps of inserting an elongated bending core coaxially in an elongated outer tube, said core having at least one recess extending along the longation of said core; inserting an elongated inner tube into said recess so that said inner and outer tubes together constitute the jacketed tube; and bending the jacketed tube about an axis normal to the longitudinal axis of the jacketed tube to thereby bend said inner and outer tubes simultaneously.

According to a further concept of the present invention an arrangement for bending an elongated jacketed tube, including an outer tube and an inner tube extending inside the outer tube, comprises bending core means including at least one bending core fittingly received in the outer tube and having at least one recess extending along the elongation of said core and operative for receiving the inner tube; and means for bending the jacketed tube about an axis normal to the longitudinal axis of the jacketed tube to thereby bend the inner and outer tubes simultaneously.

Such an arrangement renders it possible to bend the jacketed tube, having the eccentric inner tube in one bending step.

In accordance with the present invention the inner tube is of one-piece, which fact is advantageous with respect to the prior art inner tube which usually consists of a plurality of separate parts. The complicated steps of connecting these parts to one another are eliminated by the present invention. Besides, the present invention excludes the steps of consecutive insertion of the separate parts of the inner tube into the outer tube. Such a simplification, together with a simple construction of the arrangement, renders it possible to considerably reduce the expenses of manufacture of the bent jacketed tubes.

In order to bend the jacketed tubes which include the eccentric inner tube of relatively large diameter, the bending core means are provided with an additional bending core which is operative for guiding the eccentric inner tube. This additional bending core is inserted inside the eccentric inner tube.

Another advantageous feature of the present invention resides in providing means for maintaining said inner tube parallel to said outer tube during the bending process. In order to keep the inner tube extending inside the outer tube parallel thereto said one bending core or said additional bending core (or both bending cores) may be pivoted relative to the outer tube.

In accordance with another advantageous feature of the present invention the depth of the recess may be adjusted so as to receive the inner tube in the outer tube with different eccentricity. The bending core is provided with an insert which is located in the recess of the core so as to at least partially obstruct this recess. The insert bounds together with the corresponding opposite portion of the inner surface of the outer tube a passage available for the inner tube. This insert may be removable and/or adjustable in this recess so as to vary the corresponding dimension of the passage for the inner tube. Thus, the inner tube may be easily inserted in this passage with different eccentricity relative to the outer tube.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a longitudinally sectional view of an arrangement for beinding an eccentric jacketed tube in accordance with the present invention;

FIG. 2 is a sectional view taken along the line A–B in FIG. 1;

FIG. 3 is a sectional view taken along the line A–B of another embodiment of the arrangement shown in FIG. 1;

DESCRIPTION OF THE PREFERRED EMBODIMENTS

Figures 4, 5:
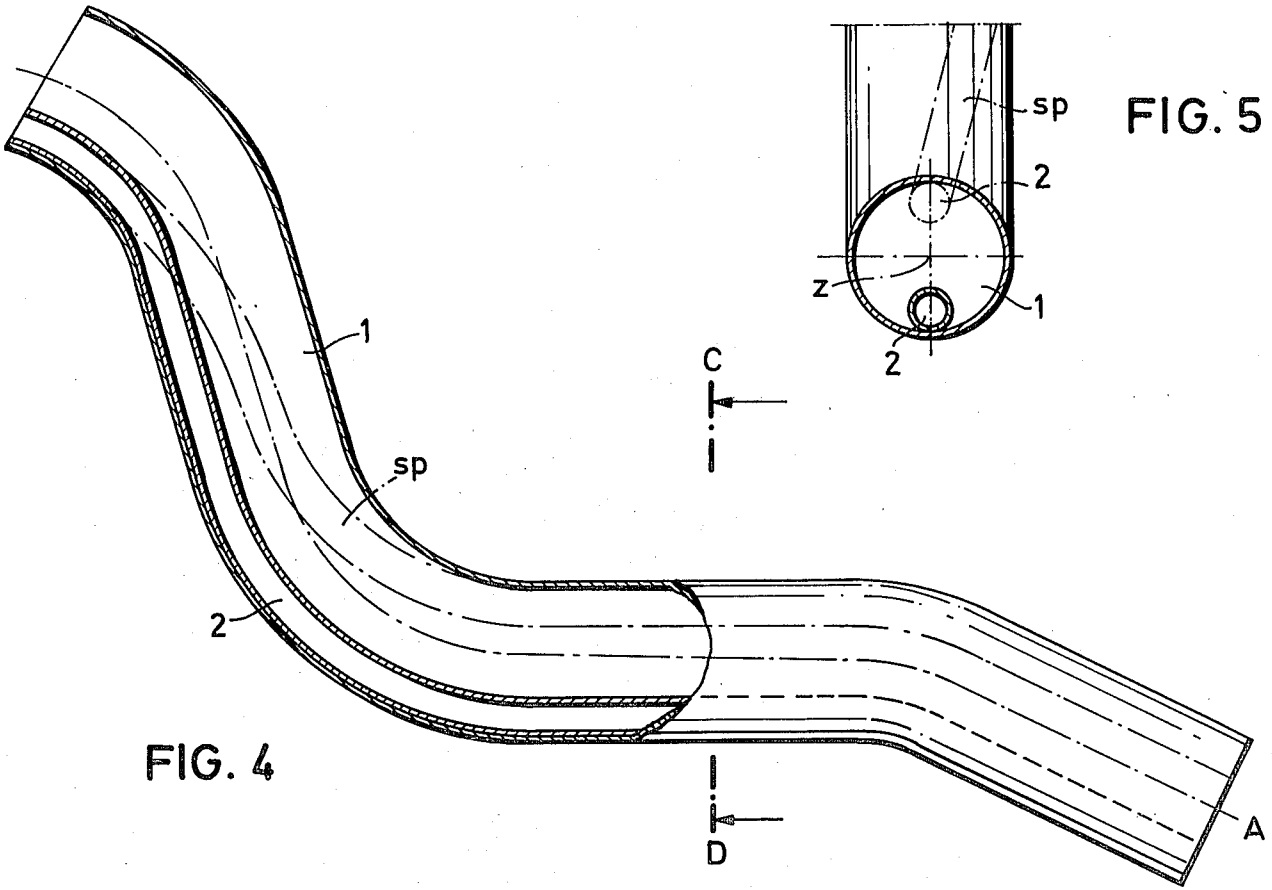
FIG. 4 is a longitudinal view of a double-bent jacketed tube.
FIG. 5 is a sectional view taken along the line C–D in FIG. 4.

Referring now to the drawings and first to the FIG. 1 thereof, it may be seen that a jacketed tube includes an outer tube 1 and an inner tube 2 which extends inside the outer tube 1. The inner tube 2 may be extended coaxially or eccentrically relative to the outer tube 1 (see FIG. 1). The inner tube 2 is inserted in the outer tube 1 by a predetermined distance before the bending process starts. Both tubes 1 and 2 are installed on a bending core 3. However, it is to be understood that the bending core 3 may be inserted first into the outer tube 1, and then the inner tube 2 is inserted into the outer tube 1 and into the bending core 3. It is also possible to insert the inner tube 2 into the bending core 3 and then the outer tube 1 is installed onto the bending core 3.

The bending core 3 is fixedly connected to a steering rod 5 which is mounted on a guide 4 for angular displacement therewith. There are further provided a template 6 with a clamping jaw 8 which are rotatable about an axis 7 in direction of an arrow 10. The jacketed tube (that is, the outer tube 1 and the inner tube 2) is located with its portion to be bent between the bending template 6 and the clamping jaw 8 which is rotatably connected with the template 6. In order to bend the jacketed tube (which has the inner tube 2 extending eccentrically relative to the outer tube 1) in one bending step the bending core 3 is provided with a recess 3*a* which extends along the elongation of the core 3. The recess 3 may extend throughout the core 3 (see FIG. 1). The inner tube 2 is received in the recess 3. Thus, the bending core 3 serves two purposes, namely the core 3 serves as a bending support for the jacketed tube and also as a bending guide for the inner tube 2. In order to ensure axial alignment of the inner and outer tubes after the jacketed tube has been bent, the end portions at least at one end of the inner and outer tubes are connected to each other, for example by means of a clip 13 (see FIG. 1), before the bending process starts.

The recess 3*a* (see FIG. 2) may be offset relative to a center point Z of the bending core 3. In this case the inner tube 2 extends eccentrically relative to the outer tube 1. However, the recess 3*a* may extend from one side of the bending core 3 past the center point Z. In this case the inner tube 2 may be so arranged in the recess 3*a* relative to the center point Z that the inner tube 2 will extend in the bending core 3 coaxially thereto. Since the core 3 is always coaxial with the outer tube 1, then the inner tube 2 extending coaxially with the core 3 extends coaxially with the outer tube 1. The recess 3*a* may be made to extend throughout the length of the core 3 and also transversely to the elongation thereof. The recess 3*a* receives an insert 3″ which may be removable and/or adjustable in the recess 3*a*. The insert 3″ has a bottom surface 3*a*′ which faces towards the corresponding inner surface of the outer tube 1 and bounds together with the same the passage 3*a*″ for receiving the inner tube 2.

Thus, the arrangement for cold bending the jacketed tube may be used, if so desired, for bending the coaxial inner and outer tubes. The same arrangement, however, may be used for bending the jacketed tube which has the inner tube extending eccentrically inside the outer tube. For this purpose, the transverse dimension of the passage 3*a*″ may be adjusted by means of the insert 3″. (see FIG. 3). The insert 3″ is installed in the passage 3*a* and by adjusting the insert 3″ relative to the center Z, one may choose whether the inner tube 2 will extend (upon its insertion in the passage 3*a*″) coaxially or eccentrically (with a different degree of eccentricity) relative to the outer tube 1. The insert 3″ may be adjusted by means of an adjusting member 9 (e.g., a setting screw).

Before the bending process starts, the bending core 3 is angularly displaced by the steering rod 5 from the position shown in FIG. 3 by an angle sufficient to arrange the elongation of the recess 3*a* at an angle respective to the direction of the arrow 10. This has to be done to provide the inner tube 2 with a supporting surface 14 in the direction of the bending force (i.e., arrow 10) so as to eliminate an otherwise possible displacement (i.e., inclination) of the portion of the inner tube 2 within the recess 3*a*.

During the bending process, the bending template 6 and the clamping jaw 8 are pivoted about the axis 7 in the direction of the arrow 10 by a predetermined angle so as to correspondingly bend the jacketed tube located between the template 6 and the clamping jaw 8. The inner tube 2 may extend in the outer tube 1 parallel thereto (see FIGS. 1 and 4). However, the inner tube 2 may extend spirally inside the outer tube 1 forming a spiral configuration Sp which is shown in FIG. 4 by a dash-dot line. In this case, the position of the inner tube 2 inside the outer tube 1 may be changed as shown in FIG. 5. In order to do so, it is only necessary to pivot the steering rod 5 during the bending process by an angle corresponding to a predetermined bending radius. The steering rod 5 rotates on the guide 4 in the direction of the arrow 11.

Figure 6:
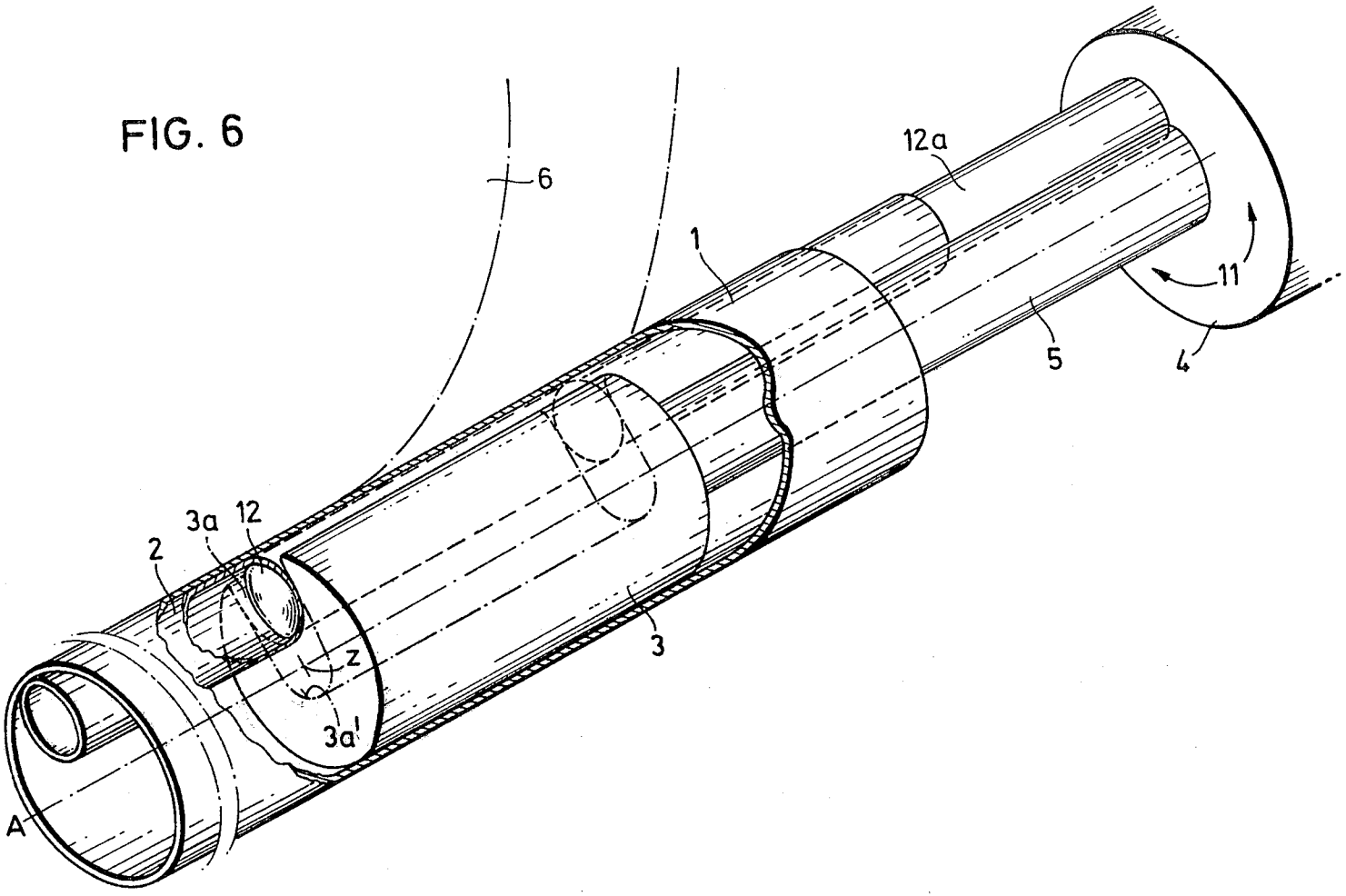
FIG. 6 is a perspective view of the arrangement.

The bending process of the jacketed tube (with the coaxial or eccentric inner tube 2) may be carried out even if the inner tube 2 has a critical dimension of the wall thickness relative to that of the outer tube. It is to be noted that if the wall thickness of the inner tube 2 is critically samll relative to that of the outer tube 1, undesired crinkles or corrugations may take place on the inner tube 2. In order to avoid these undesired consequences there is provided an additional bending core 12 (see FIG. 6). The additional bending core 12 may have a tubular cross-section and is introduced into the inner tube 2 in the area of the bending core 3 and/or elsewhere along the elongation of the inner tube 2 thereby varying the elongation of a portion of the inner tube to prevent any corrugating or crinkling of the inner tube during bending.

In order to be able to bend the inner tube 2 either parallel or non-parallel relative to the outer tube 1 (similar to the situation discussed thereabove with regard to FIG. 4), there is provided another steering rod 12*a*. The steering rod 12 connects the additional bending core 12 to the guide 4 so as to angularly displace the core 12 during the bending process together with the core 3.

It will be understood that each of the elements described above, or two or more together, may also find a useful application in other types of methods and arrangements for bending a jacketed tube differing from the types described above.

While the invention has been illustrated and described as embodied in a method and an arrangement for bending jacketed tube, it is not intended to be limited to the details shown, since various modifications and structural changes may be made without departing in any way from the spirit of the present invention.

Without further analysis, the foregoing will so fully reveal the gist of the present invention that others can, by applying current knowledged, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for bending, especially cold bending, an elongated jacketed tube including an outer tube and an inner tube extending inside the outer tube, said arrangement comprising bending core means, including at least one bending core fittingly received in the outer tube and having at least one recess extending along the elongation of said core and operative for receiving the inner tube; means for bending the jacketed tube about an axis normal to the longitudinal axis of the jacketed tube to thereby bend the inner and outer tubes simultaneously with said means for bending the jacketed tube being disposed adjacent said bending core and provided with means for holding the jacketed tube; and said bending core further comprising means for varying eccentricity of the inner tube relative the outer tube during the bending of the inner and outer tubes simultaneously.

2. An arrangement as defined in claim 1, wherein said varying means include a member movably received in said recess for movement in said recess transversely relative to the elongation of said one bending core, said member having one end surface facing the corresponding portion of the inner surface of the outer tube and constituting together with the same a passage for receiving the inner tube.

3. An arrangement as defined in claim 2, and further comprising means for adjusting said member in said recess so as to vary a dimension of said passage measured in direction substantially transversely to the elongation of said one bending core.

4. An arrangement as defined in claim 1, wherein said bending core means further include an additional bending core, said additional core being introduced into the inner tube.

5. An arrangement as defined in claim 4; wherein said additional bending core includes means for varying the elongation of at least a portion of the inner tube inside the outer tube and relative to the same.

6. An arrangement as defined in claim 5, wherein said last varying means include a member for pivoting at least one of said cores relative to the outer tube.

* * * * *